United States Patent [19]

Imamura

[11] 4,045,765

[45] Aug. 30, 1977

[54] SLIDING RESISTOR

[76] Inventor: Masao Imamura, 18-15, 1-chome, Ikegami, Ota, Tokyo, Japan

[21] Appl. No.: 760,354

[22] Filed: Jan. 19, 1977

[30] Foreign Application Priority Data

Jan. 23, 1976 Japan ..... 51-7146[U]

[51] Int. Cl.[2] ..... H01C 10/38

[52] U.S. Cl. ..... 338/176; 338/184; 338/199

[58] Field of Search ..... 338/160, 161, 164, 165, 338/176–179, 183, 184, 188, 194, 199, 202

[56] References Cited

U.S. PATENT DOCUMENTS

| | | | |
|---|---|---|---|
| 3,504,326 | 3/1970 | Campbell | 338/183 |
| 3,551,871 | 12/1970 | Eberwein et al. | 338/183 X |
| 3,671,915 | 6/1972 | Sasaki et al. | 338/176 X |
| 3,735,327 | 5/1973 | Rozema et al. | 338/176 X |

*Primary Examiner*—C. L. Albritton
*Attorney, Agent, or Firm*—Flynn & Frishauf

[57] ABSTRACT

A sliding resistor comprises a case bored with a groove in which a slider is slidably received, the slider having a sliding element formed of a leaf spring provided on the bottom plane for abutment against resistance elements mounted on a base plate. The case and slider are both molded, for example, from plastic material. The inner wall of the groove of the case has a cross section formed of a curved plane including a fractional circular portion or a polygonal plane except for the rectangular plane. The peripheral surface of the slider contacting with the inner wall of the groove has substantially the same form as that of the cross section of the inner wall of the groove of the case.

12 Claims, 7 Drawing Figures

SLIDING RESISTOR

BACKGROUND OF THE INVENTION

This invention relates to a variable resistor used in an electric, and more particularly, to a sliding resistor.

A conventional sliding resistor is constructed such that a rectangular metal case, having a groove which is rectangular in cross section, is fitted to a base plate, and a rectangular slider is slidably received in the groove. Provided at the bottom plane of the slider is a forked contact piece formed of a leaf spring. The contact piece abuts on a resistance element mounted on the base plate, resulting in that the reaction force or bias force generated by the abutment enables the rectangular slider to be pressed against the rectangular inner wall of the groove of the metal case. In order to permit a smooth sliding of the slider within the metal case, the periphery of the slider must be in good contact with the inner wall of the groove of the metal case. The conventional sliding resistor described is not satisfactory in this respect because both the periphery of the slider and the inner wall of the groove of the metal case exist on the horizontal plane. Specifically, this construction renders it difficult to permit the reaction force or bias force generated by the abutment mentioned to bring the periphery of the slider in good contact with the inner wall of the groove of the metal case, leaving an undesirable clearance therebetween. Because of the presence of the clearance, the slider tends to make undesirable shakings or joltings when moved for the adjustment of the electric resistance, resulting in irregular sliding motion and uneven sliding force.

A sliding resistor intended to remove the above drawback is known to the art. In this case, an assembly consisting of a liner and a leaf spring is provided in the undesirable clearance in question. Indeed, the bias force of the leaf spring enables the liner to make a good contact with the periphery of the slider, thereby eliminating the undesirable clearance. But, troublesome mounting work of the leaf spring and the liner is required for producing the sliding resistor of this type, resulting in a decreased manufacturing efficiency. Further, the requirement of the indispensable parts, such as the leaf spring and the liner, leads to a higher manufacturing cost of the sliding resistor.

SUMMARY OF THE INVENTION

It is generally an object of this invention to provide an inexpensive sliding resistor wherein the slider makes a smooth sliding motion with a constant sliding force without the aid of a leaf spring and a liner.

A sliding resistor according to this invention comprises a molded casing and a molded slider. A groove is provided in the molded casing. What is particularly important is that a means is provided for preventing the slider from making any undesirable shakings or joltings when moved for the adjustment of the electric resistance. This means has a first contact surface formed on the inner wall of the groove of the molded case and a second contact surface formed on the periphery of the molded slider. According to a preferred embodiment of this invention, each of the first and second contact surfaces is formed of a curved plane including substantially the same fractional circular portion and is enabled to make surface contact with each other by the bias force of a contact piece formed of a leaf spring. It follows that an undesirable clearance is not formed between the first and second contact surfaces, enabling the slider to make a smooth sliding motion with a constant sliding force.

DETAILED DESCRIPTION OF THE PREFERRED EMBODIMENTS

Figure 1:
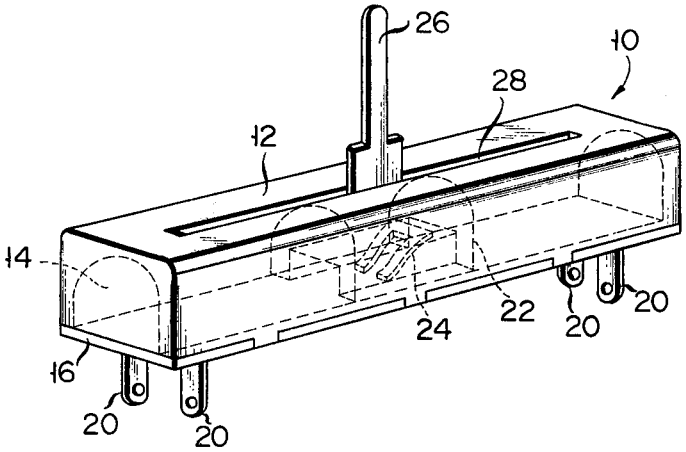
FIG. 1 is a schematic perspective view showing a sliding resistor according to one embodiment of this invention.
Figure 2:
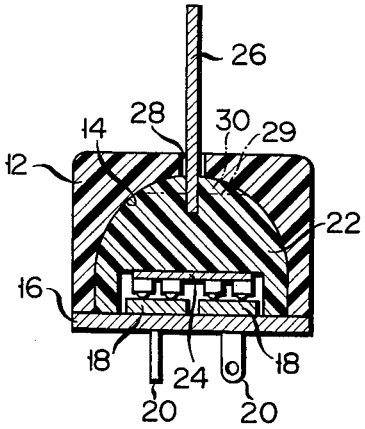
FIG. 2 is an enlarged partially cross sectional view of the sliding resistor shown in FIG. 1.

As shown in FIGS. 1 and 2, a sliding resistor 10 comprises a case 12 bored with a groove 14 whose inner wall has a cross section formed of a curved plane including a fractional circular portion, and a base plate 16 mounted on the bottom plane of the case 12. Two resistance elements 18 are provided on the base plate 16. Each resistance element 18 is fitted with two connectors 20. The resistance elements 18 are omitted from FIG. 1 to avoid complications of drawing. A slider 22 whose outer peripheral surface has substantially the same cross section as that of the inner wall of the groove 14 of the case 12 is slidably received in the groove 14. The slider 22 has a forked contact piece 24 formed of a leaf spring and provided on the bottom plane for abutment against the resistance elements 18. When abutting against the resistance elements 18, the contact piece 24 is biased to cause the slider 22 to be pressed against the inner wall of the groove 14. A lever or slider knob 26 to let the slider 22 slide through the groove 14 is erected at the center of the upper surface of the slider 22. The case 12 has an elongated slit 28 which is cut out along the axis of the case 12 to guide the sliding of the slider knob 26. The case 12 and slider 22 are both molded, for example, from plastic material or cast iron.

As mentioned above, the inner wall of the groove 14 of the case 12 has a cross section formed of a curved plane including a fractional circular portion. The slider 22 is pressed against the inner wall of the groove 14 by a force resulting from the biasing of the contact piece 24. Accordingly, a fully tight contact is established between the slider 22 and case 12, preventing the occurrence of any undesirable shakings or joltings between the slider 22 and case 12. Therefore, the slider 22 can smoothly slide horizontally through the case 12 with a constant sliding force. The sliding resistor of this invention which does not comprise a leaf spring and liner, which are indispensable parts of the prior art sliding resistor, is improved in operating efficiency, and can be manufactured at low cost due to a decrease in the number of required parts.

Obviously, the cross sections of the case 12, groove 14 and slider 22 are not limited to those used in the foregoing embodiment. For example, the slider 22 may have a different cross section from that which is substantially the same as the cross section of the groove 14. Namely, the slider 22 may be formed with such a cross section that the slider 22 has a flat apical portion 29 to provide a gap 30 relative to the curved inner wall of the groove 14. Provision of such a gap 30 still attains the fully tight contact of the slider 22 with the inner wall of the groove 14. Moreover, a reduction in the contact area between the slider 22 and groove 14 decreases the sliding force required for the slider to moved.

Figure 3A:
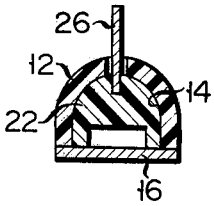
FIGS. 3*a* to 3*e* are cross sectional views similar to FIG. 2, showing sliding resistors according to other embodiments of this invention.
Figure 3B:
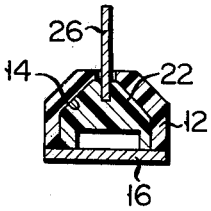
Figure 3C:
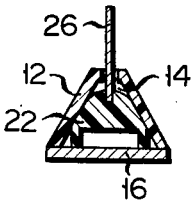
Figure 3D:
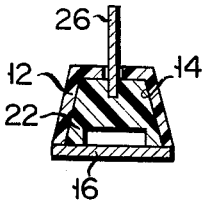
Figure 3E:
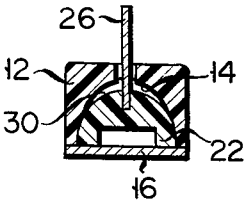

There will now be described by reference to FIGS. 3*a* to 3*e* further sliding resistor according to other embodiments of this invention. The case 12 may be built like a Quonset hut, or semicylindrical form as illustrated in FIG. 3*a*, instead of a rectangular body. The case 12 which is a molded article like the slider 22 may be easily fabricated with a pentagonal or triangular cross section as indicated in FIGS. 3*b* and 3*c*. Further, the case 12 may be built with a trapezoidal cross section as shown in FIG. 3*d*. In the above-mentioned case, the groove 14 of the case 12 well serves the purpose if it has an angular cross section formed of a pair of linearly symmetric inclined planes, in place of a curved plane including a fractional circular portion. Namely, the groove 14 may be cut out with a pentagonal, triangular or square cross section as shown in FIGS. 3*b*, 3*c* and 3*d* respectively in conformity to any of the angular cross sections of the case 12. Of course, the slider 22 abutting against the inner wall of the groove 14 is shaped substantially like the cross section of the groove 14. Where, however, the groove 14 has an angular cross section, the slider 22 may be formed with a cross section formed of a curved plane including a fractional circular or fractional elliptic portion. The groove 14 and slider 22 are preferred to have substantially the same cross section, because they can be easily fabricated in a built-up mold. If, in case the inner wall of the groove 14 has a cross section formed of a curved plane including a fractional circular portion as shown in FIG. 3*e*, the peripheral surface of the slider 22 has a cross section which has a larger curvature than the curved plane of the cross section of the groove 14, then a gap 30 may be provided between the inner wall of the groove 14 and the peripheral surface of the slider 22.

According to this invention, the inner wall of the groove 14 of the case 12 received in the slider 22 is made, as mentioned above, to have a cross section formed of a curved plane including a fractional circular portion or an angular outline including mutually facing inclined planes. The peripheral surface of the slider 22 is made to have the curved or angular cross section in conformity to the cross section of the groove 14. Since the slider 22 makes a tight linear or plane contact with the inner wall of the groove 14, there is no possibility of giving rise to a void space which might otherwise cause the slider 22 to slide through the groove 14 with undesirable shakings or joltings. Therefore, the slider 22 can smoothly slide through the groove 14 with a constant sliding force. Further, application of a lubricant such as grease on the surface of the slider 22 or the inner wall of the groove 14 decreases a sliding force required for the slider 22 to be moved through the groove 14. The slider 22 and case 12 which are molded can take various shapes, presenting excellent attractiveness with an increased commercial value. Moreover, the slider 22 and case 12 which are molded products easily provide a smooth contact plane, thereby completely preventing the occurrence of shakings or joltings while the slider 22 is moved through the groove 14 of the case 12. A further advantage of the sliding resistor of this invention is that omission of a leaf spring or liner improves the operating efficiency of the sliding resistor, and enables low cost quantity production.

What is claimed is:

1. A sliding resistor comprising:

a base plate provided with at least one resistance element connected to connectors;

a molded slider provided with a contact piece formed of a leaf spring and mounted on the bottom plane of the slider for abutment against the at least one resistance element, and a slider knob erected at the upper surface of the slider and adapted to permit the contact piece to slide in abutment against the at least one resistance element;

a molded case fixed to the surface of the base plate and provided with a groove in which the molded slider is slidably received, and a slit cut out along the axis of the case for communication with the groove, for guiding the sliding of the slider knob, the slider knob projecting upward from the slit and the molded slider being pressed against the inner wall of the molded case by a biassing force resulting from the leaf spring contact piece; and means for preventing the vertical joltings of the molded slider by causing it to contact with the inner wall of the groove of the molded case in a non-horizontal direction.

2. The sliding resistor according to claim 1, wherein the jolt-preventing means has a first contact formed on the inner wall of the groove of the molded case and a second contact surface formed on that part of the peripheral surface of the molded slider which is in contact with the inner wall of the groove.

3. The sliding resistor according to claim 2, wherein the first contact surface of the jolt-preventing means is in the form of a curved plane including a fractional circular portion, and the second contact surface is in the form of a curved plane having a curvature not smaller than that of the curved plane of the first contact surface.

4. The sliding resistor according to claim 3, wherein the fractional curved plane of the first contact surface and the fractional curved plane of the second contact surface have substantially the same curvature.

5. The sliding resistor according to claim 3, wherein the fractional curved plane of the second contact surface has a larger curvature than that of the fractional curved plane of the first contact surface.

6. The sliding resistor according to claim 2, wherein the first contact surface has a polygonal form, except for a gate-like portion of the contact surface which intersects a plane adjacent to the contact surface at right angles, and the second contact surface has substantially the same polygonal form as the first contact surface.

7. The sliding resistor according to claim 6, wherein the molded case has a polygonal cross section other than a rectangular cross section, and the first contact surface of the jolt-preventing means has substantially the same form as part of the cross section of the molded case.

8. The sliding resistor according to claim 2, wherein the first contact surface has polygonal form except for a gate-like portion of the contact surface which intersects a plane adjacent to the contact surface at right angles, and the second contact surface is formed of a curved plane including a fractional circular portion.

9. The sliding resistor according to claim 8, wherein the molded case has a polygonal cross section other than a rectangular cross section, and the first contact surface of the jolt-preventing means has substantially the same form as part of the cross section of the molded case.

10. The sliding resistor according to claim 1, wherein said slider knob is erected at the center of the upper surface of the slider.

11. The sliding resistor according to claim 1, wherein said base plate is provided with a plurality of resistance elements connected to connectors.

12. The sliding resistor according to claim 11, wherein said molded slider comprises respective leaf spring contact pieces for abutment against said plurality of resistance elements.

* * * * *